US007175479B1

(12) United States Patent
McAlonis et al.

(10) Patent No.: US 7,175,479 B1
(45) Date of Patent: Feb. 13, 2007

(54) MODULAR CONNECTOR ASSEMBLY WITH STAMPED RETENTION LATCH MEMBERS

(75) Inventors: Matthew Richard McAlonis, Elizabethtown, PA (US); Attalee S. Taylor, Palmyra, PA (US); Richard Elof Hamner, Hummelstown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/410,028

(22) Filed: Apr. 25, 2006

(51) Int. Cl.
*H01R 13/502* (2006.01)

(52) U.S. Cl. ..... 439/701; 29/750; 29/758

(58) Field of Classification Search ..... 439/701, 439/79, 885, 355, 357; 29/750, 758, 759, 29/764
See application file for complete search history.

(56) References Cited

U.S. PATENT DOCUMENTS 6,461,202 B2 * 10/2002 Kline ..... 439/701
6,709,298 B2 * 3/2004 Bradley ..... 439/701
6,875,031 B1 * 4/2005 Korsunsky et al. ..... 439/79

* cited by examiner

*Primary Examiner*—Tho D. Ta
*Assistant Examiner*—Vanessa Girardi

(57) ABSTRACT

An electrical connector is provided that comprises a housing with a front wall that separates a mating end from a loading end. The housing has a module support shroud that extends from the front wall toward the loading end and that has a latch element provided thereon. The connector also includes a contact module having an array of contacts that are held in a dielectric carrier. The contact module includes a mating end, sides and a module end. The module end slides along the module support shroud as the contact is loaded into the housing, until the mating end is located proximate to the front wall when the contact module is fully loaded. A retention latch member is formed separate from, and held by, the contact module. The retention latch member extends beyond the module edge and engages the latch element on the module support shroud to retain securely the contact module in the housing.

20 Claims, 7 Drawing Sheets

MODULAR CONNECTOR ASSEMBLY WITH STAMPED RETENTION LATCH MEMBERS

BACKGROUND OF THE INVENTION

The invention relates generally to a modular electrical connector, and more particularly to an electrical connector having a contact module with a stamped lead frame and retention latch member.

In certain connector applications, connectors are assembled with a series of contact modules or chicklets loaded into a common connector housing. Each contact module includes a dielectric carrier that surrounds an array of contacts having pins extending from opposite or adjacent ends of the carrier. In certain applications, the contact modules are formed by overmolding the carrier over the contacts, while in other applications the contact modules are formed as pre-molded back shells and covers that are press fit to one another to enclose the array of contacts. The connector housing normally includes a loading end, a connector mating end and a board mounting end. The modules are loaded, individually or in groups, into the connector through the loading end until pins on each module extend from a corresponding connector mating end and board mounting end.

Modular connectors generally include latch features to retain the modules within the housing. The latch features typically include latch members formed integral with the connector housing.

The contact modules also have latch features that are formed as an integral part of the carrier. The carrier and latch features are formed of a dielectric material, such as plastic. Hence, existing latch features are subject to break or otherwise lose a latch deflection force over time. In addition, plastic latches have limited strength, may become worn over time and may develop rounded edges that are more easily disconnected.

The need remains for an improved modular connector assembly and a contact module design that provides a more robust and reliable retention latch member.

BRIEF DESCRIPTION OF THE INVENTION

In accordance with one embodiment, an electrical connector is provided that comprises a housing with a front wall that separates a mating end from a loading end. The housing has a module support shroud that extends from the front wall toward the loading end and that has a latch element provided thereon. The connector also includes a contact module having an array of contacts that are held in a dielectric carrier. The contact module includes a mating end, sides and a module end. The module end slides along the module support shroud as the contact is loaded into the housing, until the mating end is located proximate to the front wall when the contact module is fully loaded. A retention latch member is formed separate from, and held by, the contact module. The retention latch member extends beyond the module edge and engages the latch element on the module support shroud to retain the contact module securely in the housing.

Optionally, the retention latch member and the contacts may be formed from a common stock of material and held within a common carrier strip during assembly. The retention latch member and contacts are removed from the carrier strip when assembled in the dielectric carrier. Optionally, the retention latch member may be formed of a conductive material and include a latch base that is joined at one end to a latch beam. The latch base is securely held within a chamber in the carrier, while the latch base extends out of the chamber beyond the module edge. Optionally, the carrier may include a back shell and a cover that are joined to one another by posts that extend there between. The retention latch member may then include holes there through that receive at least one post to securely retain the retention latch member within the carrier.

In accordance with an alternative embodiment, an electrical contact module is provided that is configured to be loaded into a connector housing. The contact module includes an array of contacts held in a dielectric carrier. The carrier includes a mating edge and a module edge. The mating edge is configured to be located proximate the front wall of the housing when the contact module is fully loaded into the housing. The module edge is positioned to slide along a module support shroud as the contact module is loaded into the housing. The module also includes a retention latch member that is formed separate from, and held by, the dielectric carrier. The retention latch member extends beyond the module edge and is configured to engage a latch element on the module support shroud to retain the contact module in the housing.

DETAILED DESCRIPTION OF THE INVENTION

Figure 1:
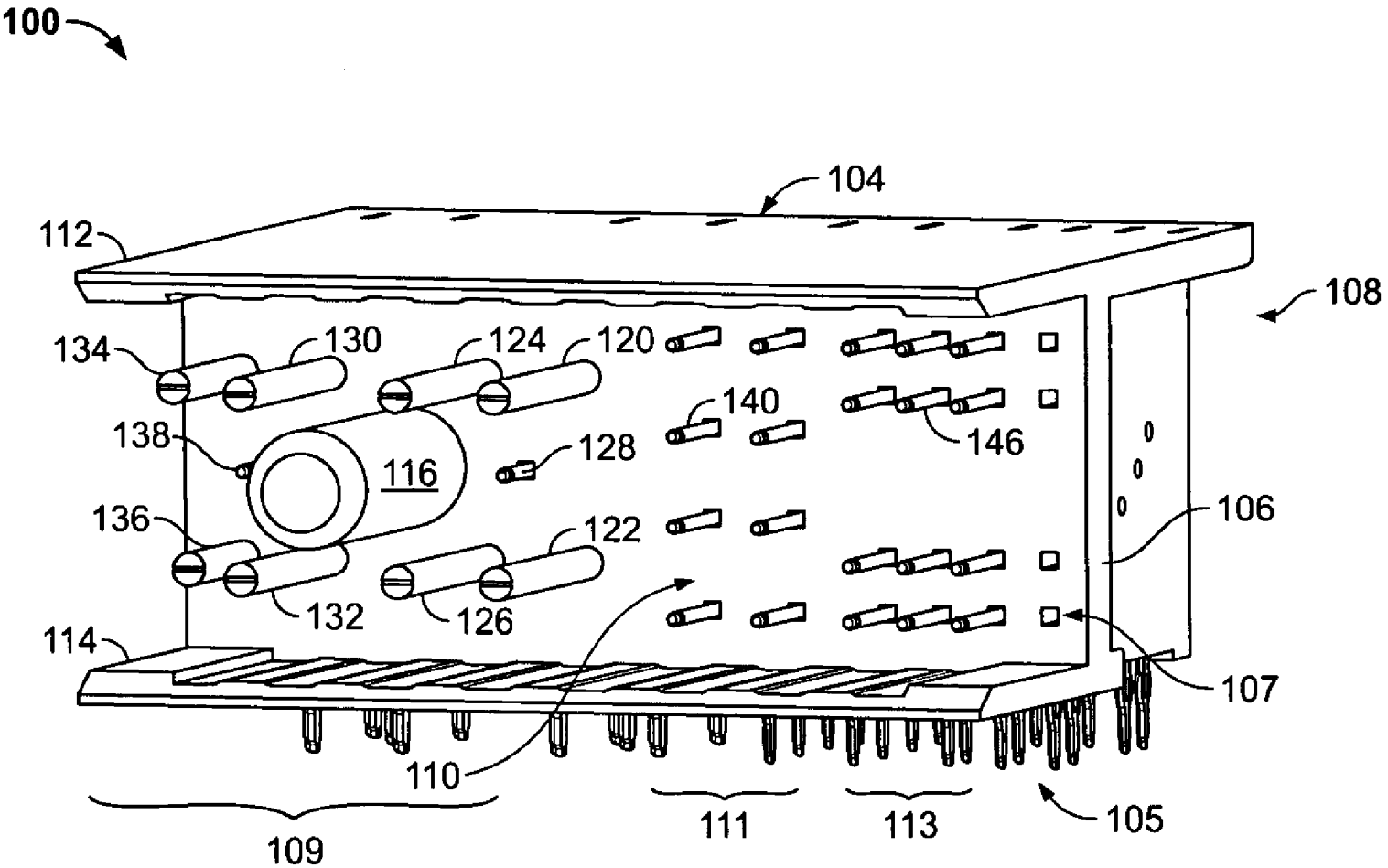
FIG. 1 illustrates a front perspective view of an electrical connector formed in accordance with an embodiment of the present invention.

FIG. 1 illustrates a front perspective view of an electrical connector 100 formed in accordance with an exemplary embodiment of the present invention. The following description is therefore provided for purposes of illustration, rather than limitation, and are but some potential applications of the inventive concepts herein. The connector 100 includes a housing 104 having a mounting end 105 and having a front wall 106 that separates a mating end 110 from a loading end 108. The housing 104 includes forward upper and lower shrouds 112 and 114, respectively, that extend forward from the front wall 106 toward the mating end 110. The upper and lower shrouds 112 and 114 may have alignment features and latching features to facilitate engagement with a mating connector. A guide post 116 extends forward from the front wall 106 toward the mating end 110 and facilitates engagement with a mating connector. The front wall 106 has a pin pattern 107 therethrough to receive pins of signal and power contacts. The pin pattern 107 is apportioned into zones or sections, such as a power delivery section 109, a first signal section 111 and a second signal section 113.

The power delivery section 109 includes, on opposite sides of the guide post 116, sets of power contacts that are grouped with signal contacts. For example, power contacts 120, 122, 124, and 126 are grouped with signal contact 128, all of which extend through the front wall 106 and are located on one side of the guide post 116. Power contacts 130, 132, 134, and 136 are grouped with signal contact 138, all of which extend through the front wall 106 and are located on the other side of the guide post 116.

The first signal section 111 includes signal contacts 140 that are arranged in columns along parallel vertical centerlines. Within each column, the signal contacts 140 are evenly spaced from one another. Adjacent columns are laterally separated from one another. The second signal section 113 includes signal contacts 146 that are arranged in columns along parallel vertical centerlines. Within each column, the signal contacts 146 are arranged in pairs. The signal contacts 146 in a pair are separated by a distance (hereafter referred to as an intra-pair spacing), while pairs are separated by a distance (hereafter referred to as an inter-pair spacing). The spacing between adjacent columns may vary depending upon the application, and may differ from the spacing between the columns and in the standard signal section 109.

Figure 2:
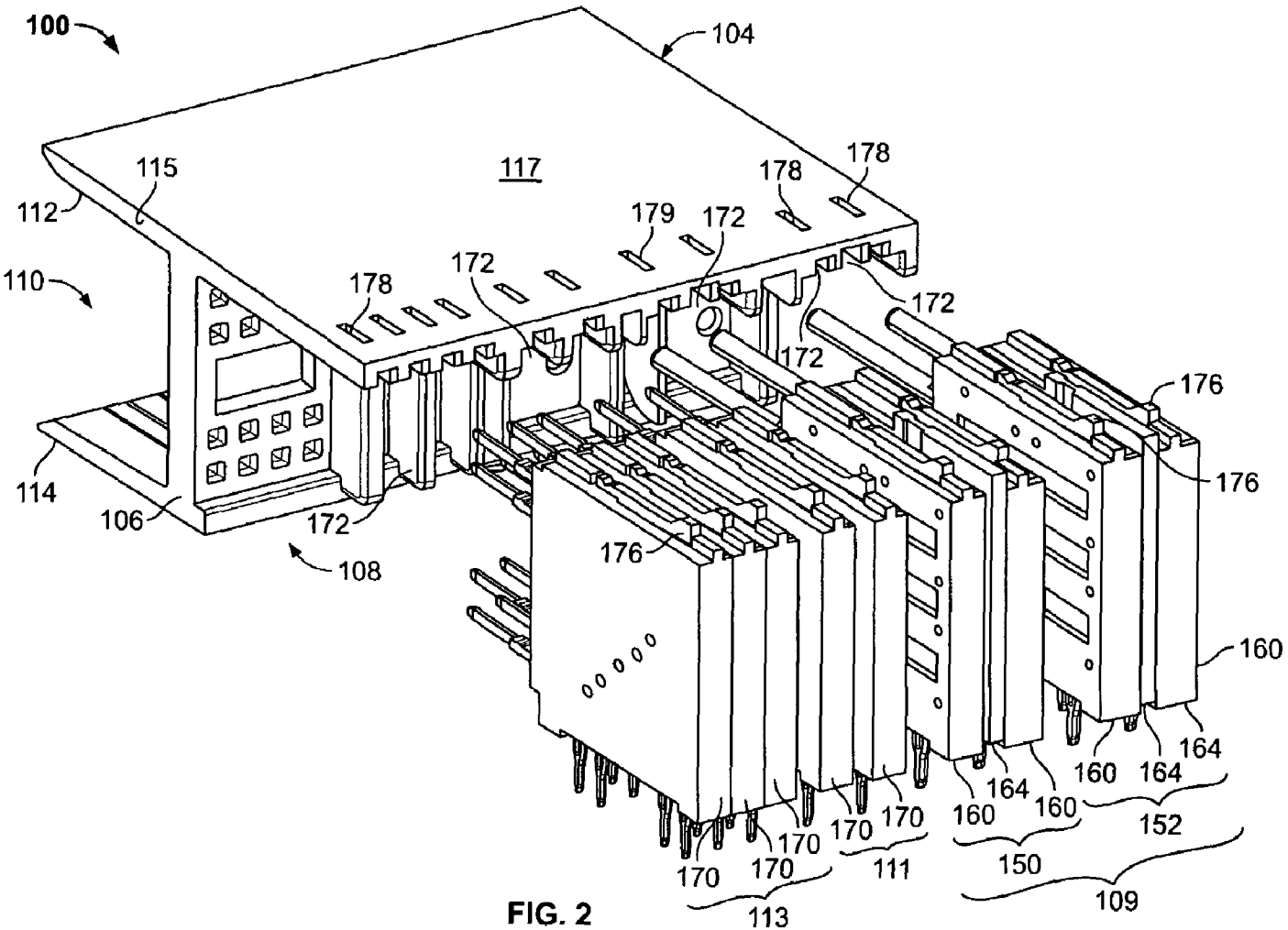
FIG. 2 illustrates an exploded rear perspective view of the electrical connector of FIG. 1 with signal and power contact modules aligned to be loaded.

FIG. 2 illustrates an exploded rear perspective view of the connector 100 and a series of signal contact modules 170 and power contact modules 150 and 152 that are aligned to be loaded. As shown in FIG. 2, the front wall 106 includes a module support shroud 115 that extends toward the loading end 108. The module support shroud 115 includes a series of slots 172 provided therein that extend from the front wall 106 and open downward. The slots 172 may be dimensioned differently to ensure loading of a corresponding power or signal contact module 150, 152 or 170. The module support shroud 115 includes a top surface 117 that has latch windows 178 therein. The windows 178 represent latch elements and extend through the module support shroud 115 from the top surface 117 into the slots 172. At least one window 178 is aligned with each slot 172. Each window 178 includes a window latch surface 179 located at a rear end of the window 178. Each power and signal contact module 150, 152 and 170 includes a latch 176 that is received in a corresponding window 178. The latches 176 and corresponding windows 178 cooperate to lock the power and signal contact modules 150, 152 and 170 in the housing 104.

The power delivery portion 109 of the connector 100 receives a first power module 150 and a second power module 152. Power module 150 includes power contacts 120, 122, 124, and 126 and signal contact 128 (FIG. 1). Power module 152 includes power contacts 130, 132, 134, and 136 and signal contact 138. Each of power modules 150 and 152 includes a pair of power contact wafer assemblies 160 separated by a spacer 164. The power contact wafer assemblies 160 are identical and interchangeable. Optionally, the power contact modules 150 and 152 may each include a single power contact wafer assembly 160, in which case the terms "module" and "wafer assembly" would be used interchangeably to refer to a common structure. The power contact wafer assembly 160 includes a pair of power contacts that may be either power contacts 120 and 122, power contacts 124 and 126, power contacts 130 and 132 or power contacts 134 and 136 depending on the position in the power modules 150 and 152. Each contact module and contact wafer assembly is generally square or rectangular in shape and has opposed sides that extend along generally parallel planes. Each contact module and contact wafer assembly is surrounded by edges that are shaped to match a contour of the housing 104 and a circuit board.

The signal sections 111 and 113 of the connector 100, that receive signal contact modules 170, may comprise one or more wafer assemblies. The power wafer assemblies 160, spacers 164, and contact modules 170 are received in corresponding slots 172 that are formed in the connector housing 104.

Figure 3:
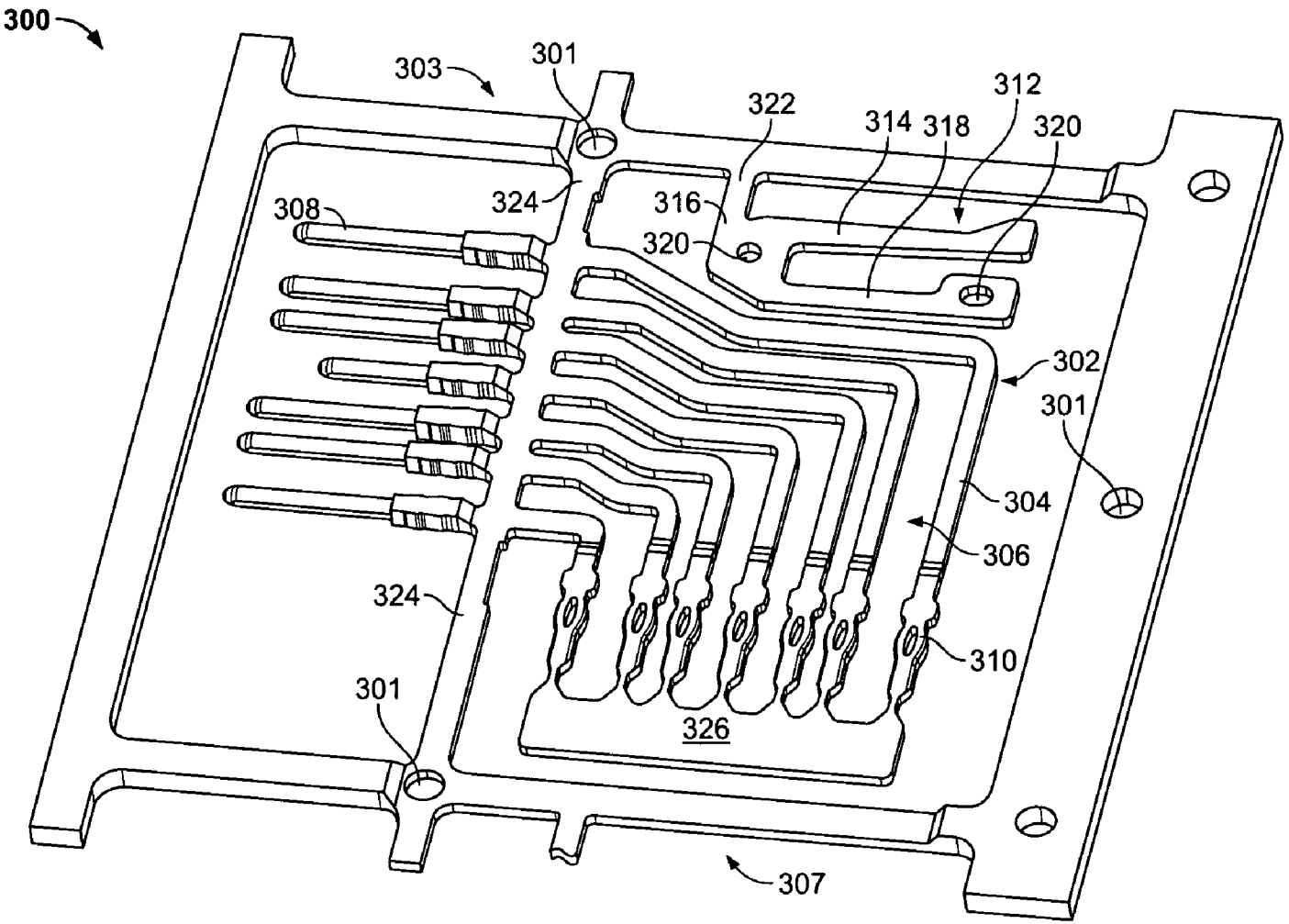
FIG. 3 illustrates a portion of a carrier strip holding a generic lead frame and retention latch member during a manufacturing process implemented in accordance with an embodiment of the present invention.

FIG. 3 illustrates a portion of a carrier strip 300 that has a master or generic signal contact lead frame 302 and a retention latch member 312 jointly stamped therein. The retention latch member 312 is one example of the structure for the latch 176 (FIG. 2). The carrier strip 300 includes a series of generic lead frames 302 and retention latch members 312 (only one of which is shown). While not shown, it is understood that a series of common lead frames 302 and retention latch members 312 are provided along the carrier strip 300 at opposite ends 303 and 307. The carrier strip 300 includes a series of holes 301 distributed there about that are used during manufacture to convey the carrier strip 300 along an assembly process between various stages. The generic lead frame 302 comprises multiple contacts 304 that are formed in an array and are spaced-apart from one another by contact-to-contact gaps 306. The widths of the contact-to-contact gaps 306 differ depending upon the contact configuration. Each contact 304 has a connector mating pin 308 provided at one end thereof and a board mounting pin 310 provided at the opposite end. In the embodiment of FIG. 3, the board mounting pins 310 are formed as "eye of the needle" pins. The connector mating pins 308 may have different links from one another as shown in FIG. 3. The contacts 304 in the generic lead frame 302 are held within the carrier strip 300 by tabs 324, while a linking bar 326 joins the board mounting pins 310. The tabs 324 and the linking bar 326 maintain adjacent contacts 304 in a predetermined spaced-apart relationship and orientation with respect to one another and with respect to the carrier strip 300.

The carrier strip 300 also includes a retention latch member 312 stamped therein at the same time as the generic lead frame 302. The retention latch member 312 includes a latch beam 314 that is joined at a link area 316 to a latch base 318. The latch beam 314 and latch base 318 extend along generally parallel axes. The link area 316 and an outer end of the latch base 318 include holes 320 therethrough. The retention latch member 312 is held on the carrier strip 300 by a tab 322. The tab 322 maintains the retention latch member 312 in a predetermined spaced-apart relationship and orientation with respect to the carrier strip 300 and generic lead frame 302.

Figure 4:
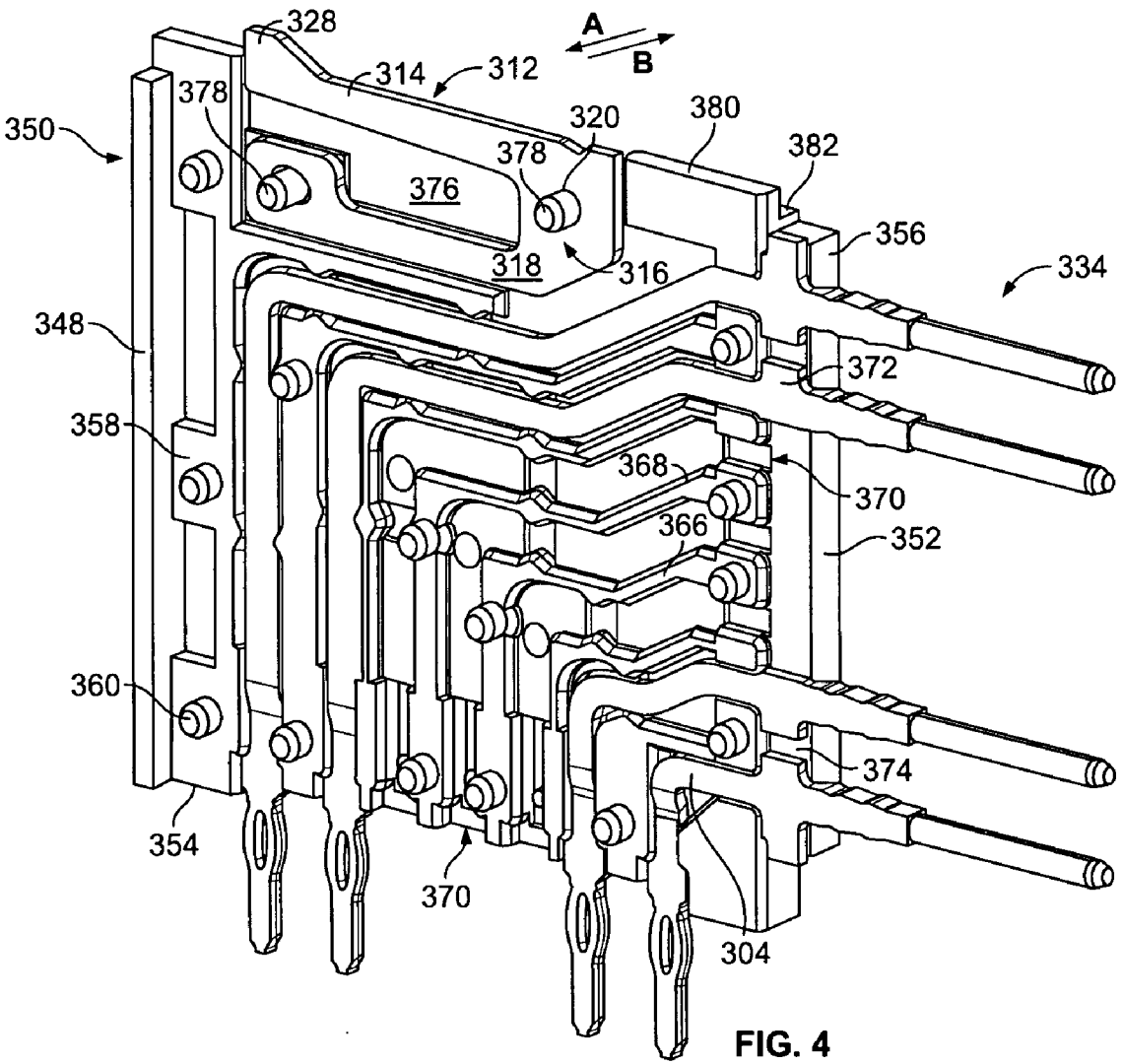
FIG. 4 illustrates a first pattern of signal contacts and the retention latch member of FIG. 3 loaded in a back shell of a contact module.

FIG. 4 illustrates a side perspective view of a contact pattern 334 when mounted in a back shell 350 of a dielectric carrier which forms a portion of a signal contact module or wafer assembly (as explained below in more detail). The back shell 350 includes a connector mating edge 352 and a board mounting edge 354 that are arranged at a right angle to one another in the exemplary embodiment. It is understood that in other configurations, the mating edge 352 and board mounting edge 354 may not be oriented at a right angle to one another. The back shell 350 includes an outer surface 356, an inner surface 358, a top edge 382, and a rear ledge 348. The inner surface 358 includes a series of ribs 366 that are separated from one another to form channels 368 therebetween. The ribs 366 and channels 368 extend between the mating and board mounting edges 352 and 354 along curved paths that substantially follow the curvature of contacts 304. The channels 368 are open at opposite ends 370.

Adjacent contacts 304 are separated from one another at gaps 374 during the manufacturing process before or after being loaded into the back shell 350. Once the adjacent contacts 304 are separated at gaps 374, shoulder portions 372 remain and are located proximate to the ends 370 of the channels 368. The shoulders 372 resist movement of the contacts 304 relative to the back shell 350 during mating operations, and retain the contacts 304 in a desired spaced-apart relationship with respect to one another.

The ribs 366 and channels 368 are arranged in a master or generic channel pattern that corresponds to the common or master contact pattern of the generic lead frame 302. By providing a generic channel pattern in the back shell 350, any back shell 350 may be used with any contact pattern formed from the generic lead frame 302. The back shell 350 also includes a distribution of pins 360 that project from the inner surface 358. The pins 360 are positioned to be received in corresponding holes in a mating cover when the cover is securely joined to the back shell 350. The back shell 350 and cover cooperate to form a dielectric carrier that surrounds and holds an array of contacts 304 in the first contact pattern.

The back shell 350 also includes a cavity 376 that receives the retention latch member 312. Pins 378 are located in the cavity 376 and are aligned to be inserted through the holes 320 in the retention latch member 312 in order to position and retain the retention latch member 312 in a desired relation relative to the back shell 350. The back shell 350 includes an alignment rail 380 extending upward from the top edge 382. The alignment rail 380 is configured to be received in a corresponding slot 172 in the module support shroud 115 (FIG. 2). The retention latch member 312 includes a protrusion 328 that extends upward from an outer end of the latch beam 314. The protrusion 328 extends above the alignment rail 380. During a loading operation, as the alignment rail 380 is received in the corresponding slot 172, the latch beam 314 is deflected downward in the direction of arrow A to permit the protrusion 328 to pass into the slot 172 until aligning with the window 178. When the protrusion 328 aligns with the window 178, the latch beam 314 moves in the direction of arrow B to securely position the protrusion 328 within the window 178. The pins 378 prevent the link area 316 and latch base 318 from moving relative to the back shell 350 during the latching process.

Figure 5:
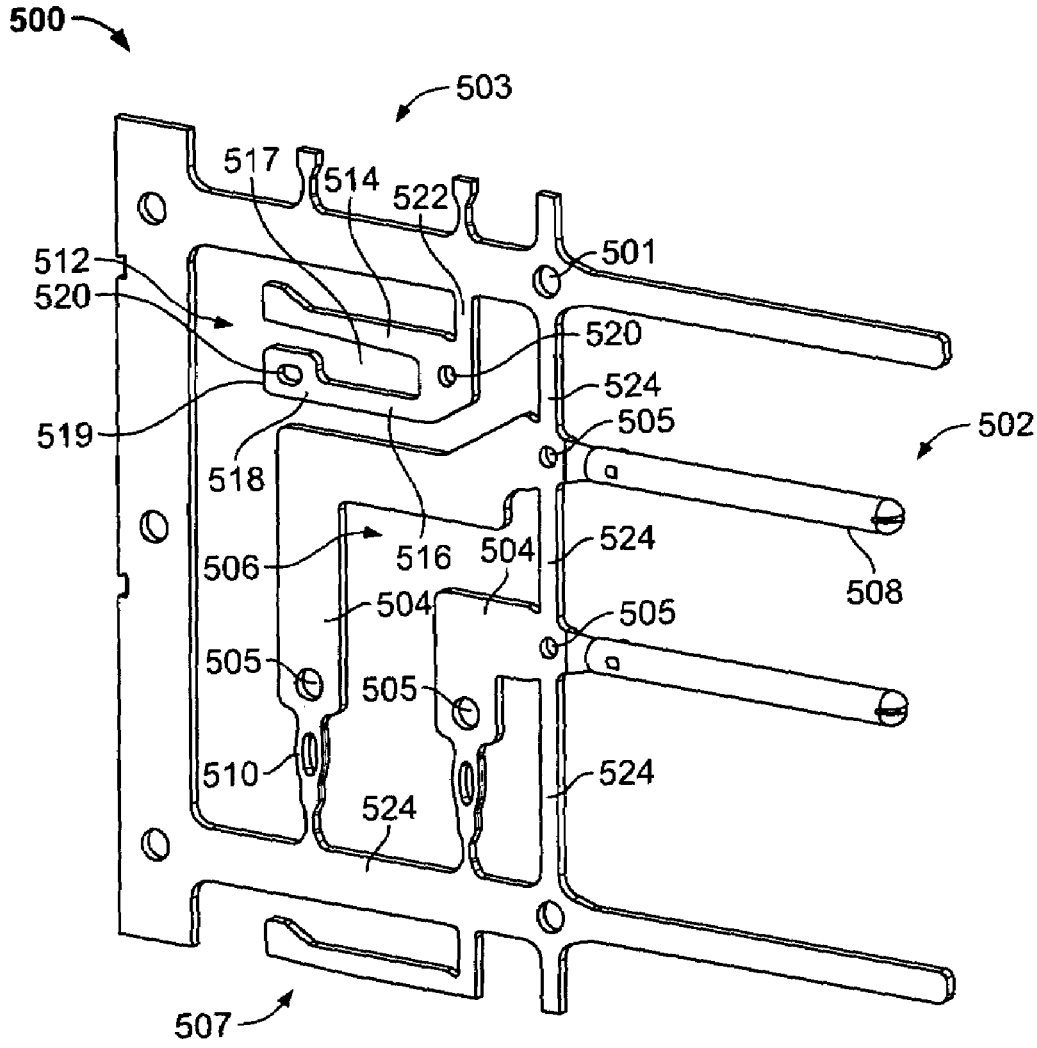
FIG. 5 illustrates a power contact lead frame.

FIG. 5 illustrates a portion of a carrier strip 500 to show a single power contact lead frame 502 having an array of contacts 504 held by tabs 524 in a desired contact pattern. While not illustrated, it is understood that a series of common lead frames 502 are provided along the carrier strip 500 at opposite ends 503 and 507 thereof. The contacts 504 are separated by a contact gap 506, and each contact 504 includes connector mating pins 508 and board mounting pins 510 provided at opposite ends thereof. The contacts 504 include holes 505 that are located proximate to the connector mating pins 508 and board mounting pins 510. The holes 505 are configured to receive posts extending through the contact module to retain each contact 504 in a desired position and orientation with respect to the contact module. The carrier strip 500 also includes holes 501 that are used to convey the carrier strip 500 along an assembly process.

The lead frame 500 into also includes a retention latch member 512 that is held by a tab 522 on the carrier strip 500. The retention latch member 512 and lead frame 502 extend along, and are held in, a common plane. The tab 522 maintains the retention latch member 512 in a predetermined orientation and spaced apart relation from the array of contacts 504. The orientation and spacing between the retention latch member 512 and array of contacts 504 is maintained in a final assembled contact module (described below).

The retention latch member 512 includes a latch beam 514 that is joined at one end, through a link area 516, to a latch base 518. The latch beam 514 and the latch base 518 extend along directions substantially parallel to one another and are spaced apart by an open area 517. An outer end 519 of the latch base 518 and the link area 516 include holes 520 that are configured to receive posts (described below) to retain the retention latch member 512 in a desired position and orientation with respect to a contact module.

Figure 6:
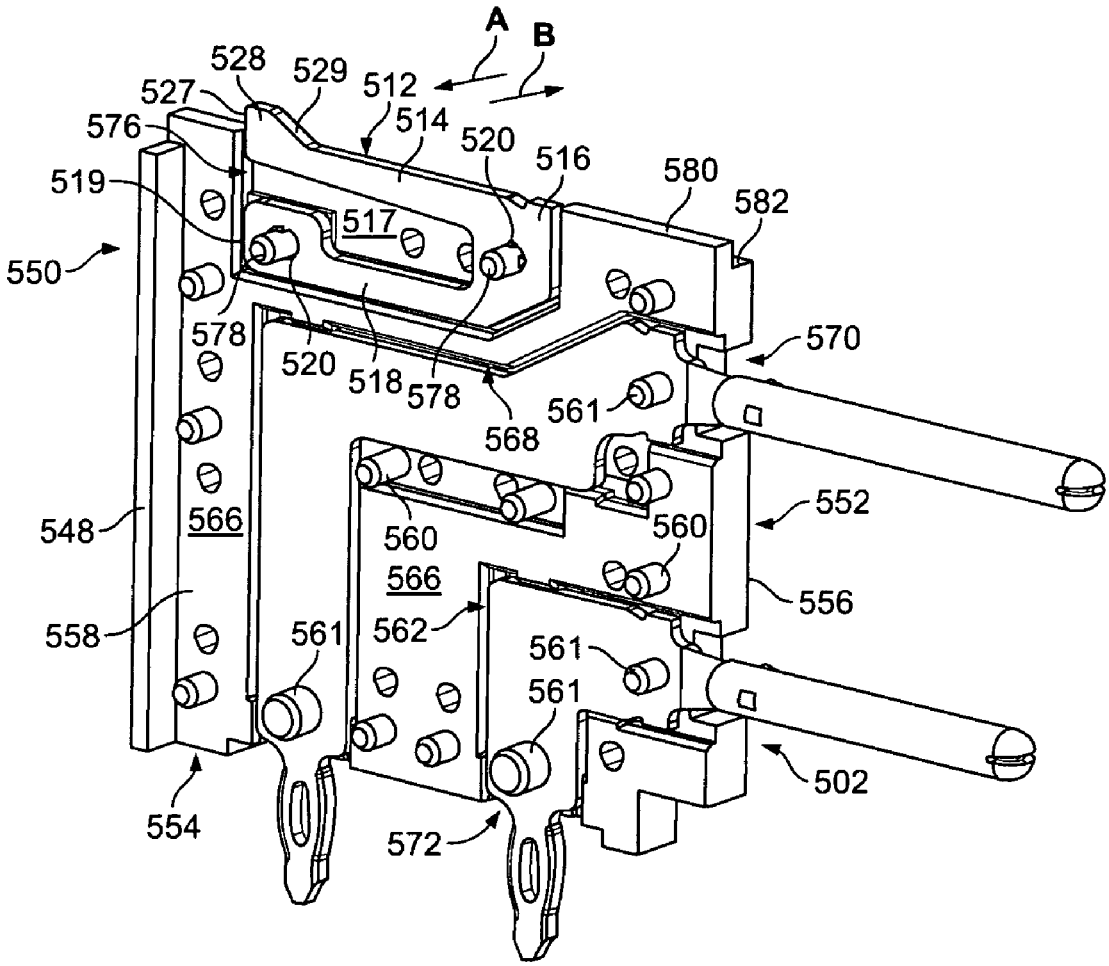
FIG. 6 illustrates a side perspective view of a power contact lead frame after the carrier strip has been removed and the lead frame has been mounted to a back shell.

FIG. 6 illustrates a side perspective view of the lead frame 502 and retention latch member 512 after the carrier strip 500 (FIG. 5) has been removed and the lead frame 502 and retention latch member 512 has been mounted to a back shell 550. The back shell 550 forms a portion of a power contact module or power contact wafer assembly 150 (FIG. 2). The back shell 550 includes a mating edge 552 and a board mounting edge 554 that are arranged at a right angle to one another in the exemplary embodiment. The back shell 550 includes an outer surface 556, and inner surface 558, a top edge 582 and a rear ledge 548. The inner surface 558 includes a series of ribs 566 that are separated from one another to form channels 568 there between. The ribs 566 and channels 568 extend between the mating and board mounting edges 552 and 554 along curved paths that substantially follow the curvature of the contacts 504 (FIG. 5).

The back shell 550 also includes a distribution of posts 560 that extend outward from the inner surface 558. The posts 560 are configured to be received in corresponding holes 588 (FIG. 7) and a mating cover 564 when the cover 564 is securely joined to the back shell 550. The back shell 550 and cover 564 cooperate to form the dielectric carrier that surrounds and holds the array of contacts 504 in a desired power contact pattern. The back shell 550 also includes posts 561 that are positioned within the channels 568 and are located proximate to opposite ends 570 and 572 of the corresponding channel 568. The posts 561 are positioned to align with the holes 505 (FIG. 5) that are formed through the contacts 504. The posts 561 retain the contacts 504 in a desired position and orientation within the back shell 550.

The back shell 550 also includes a cavity 576 that receives the retention latch member 512. Posts 578 are located in, and extend from, the cavity 576. The posts 578 are positioned to be inserted through the holes 520 in the latch base 518 and in the link area 516. The posts 578 retain the retention latch member 512 in a desired position and orientation within the back shell 550. The relative position and orientation between the retention latch member 512 and contacts 504 remain the same in the back shell 550 originally established when stamped in the lead frame 502 (FIG. 5). The back shell 550 also includes an alignment rail 580 that extends upward from the top edge 582. The alignment rail 580 is configured to be received in a corresponding slot in the module support shroud 115 (FIG. 2). The retention latch member 512 includes a protrusion 528 that extends upward from an outer end of the latch beam 514. The protrusion 528 extends above a top surface of the alignment rail 580. The protrusion 528 includes a sloped surface 529 that facilitates the loading operation. The latch beam 514 also includes a latch surface 527 that is directed toward the rear ledge 548. The latch surface 527 securely abuts against a wall within the window 178 (FIG. 2) to form a locking relation there between.

As the power contact wafer assembly 160 (FIG. 2) is loaded into the housing 104, the alignment rail 580 is received in a corresponding slot in the housing 104. The latch beam 514 deflects downward in the direction of arrow A to permit the protrusion 528 to pass into the slot 172 (FIG. 2) until aligning with the window 178. When the protrusion 528 aligns with the window 178, the latch beam 514 moves in the direction of arrow B to securely position the protrusion 528 in the window 178. The post 578 prevents the link area 516 and the latch base 518 from moving relative to the back shell 550 during the latching process thereby providing a desired deflection force.

Figure 7:
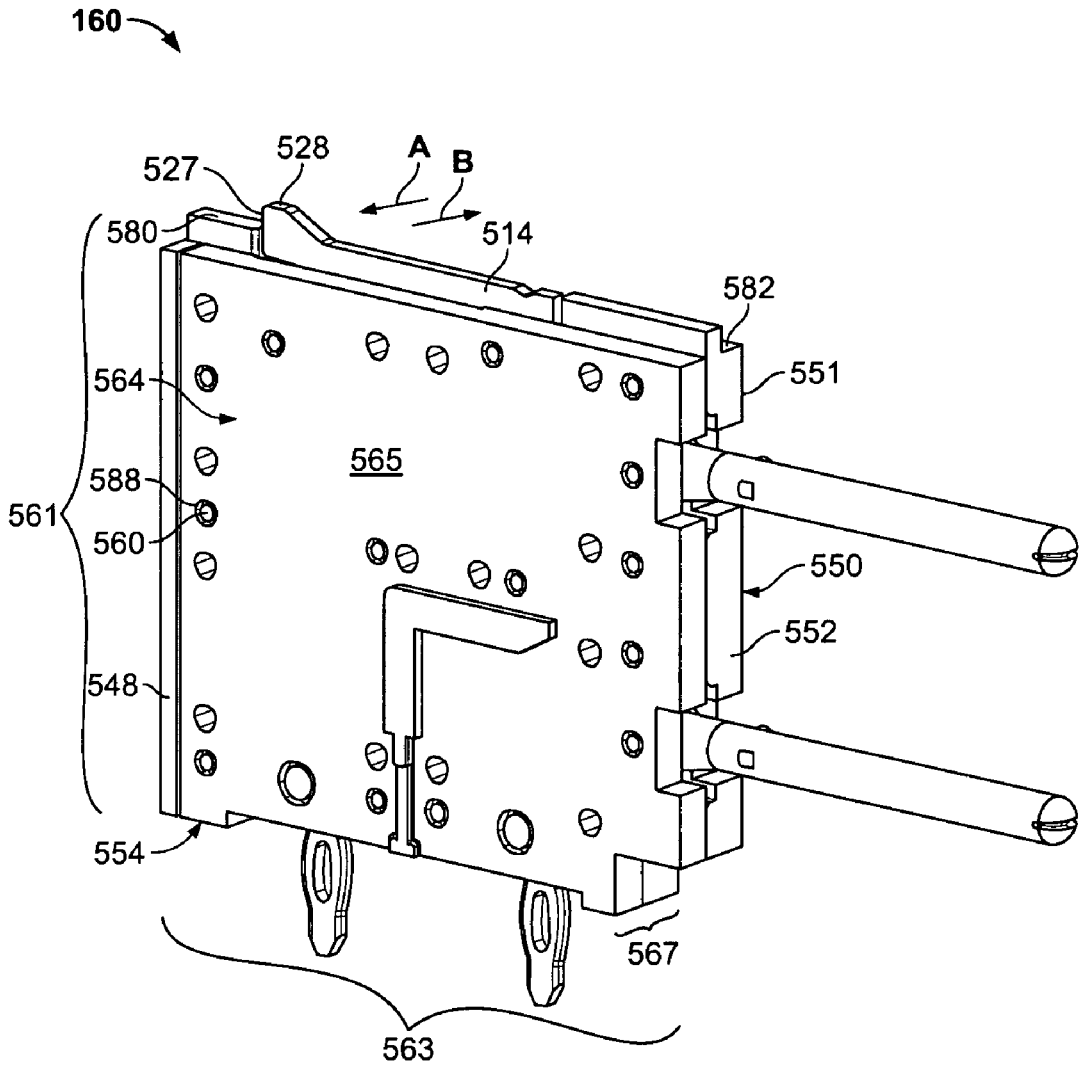
FIG. 7 illustrates a side perspective view of a power contact module that is formed when the power contact pattern is loaded into back shell and a corresponding cover is secured to the back shell.

FIG. 7 illustrates a side perspective view of a power contact wafer assembly 160 that is formed when the power contact pattern is loaded into back shell 550 and a corresponding cover 564 is secured to the back shell 550. The cover 564 and back shell 550 are held together by a friction fit between the posts 560 and holes 588. As shown in FIG. 7, the protrusion 528 extends upward above a top surface of the alignment rail 580. The latch beam 514 is deflected downward in the direction of arrow A until the protrusion 528 clears under the module support shroud 115 (FIG. 2). Once the protrusion 528 aligns with a corresponding window 178, the latch beam 514 returns to its normal resting position, at which latch surface 527 is securely retained within the corresponding window 178.

The power contact wafer assembly 160 has a height 561 between the board mounting edge 554 and top edge 582, and a length 563 between the rear ledge 548 and mating edge 552. The cover 564 and back shell 550 have opposed outer sides 565 and 551, respectively, that are separated by a thickness 567. The thickness 567 is narrow or small relative to the height 561 and length 563. The sides 565 and 551 extend along parallel planes.

The retention latch members are formed of a hard material, such as metal. The retention latch members are formed of the same material as the contacts. Hence, the retention latch members exhibit good deflection memory as the latch beams return to their original positions even after extended use. The retention latch members are also robust as they resist breaking and wearing after repeated latching and unlatching operations.

In the above examples, the latch beam is shown to extend along a plane containing the lead frame and is to be directed toward the rear edge of the contact modules. Optionally, the latch beams may be directed in a different direction, such as toward the mating end. Optionally, the latch beam may be bent and formed after being stamped. For example, the latch beam may be bent sideways out of the plane containing the lead frame.

Optionally, more than one of the retention latch members may be provided in a single contact or power module. Optionally, the retention latch member may be located along one of the rear ledge and board mounting end of the contact or power module. Optionally, the latch retention member may extend laterally through an opening in one or both of the cover and back shell.

While the invention has been described in terms of various specific embodiments, those skilled in the art will recognize that the invention can be practiced with modification within the spirit and scope of the claims.

What is claimed is:

1. An electrical connector comprising:

a housing with a front wall separating a mating end from a loading end, the housing having a module support shroud extending from the front wall toward the loading end, the module support shroud having a latch element provided thereon;

a contact module including an array of contacts held in a dielectric carrier, the contact module including a mating end that is located proximate the front wall of the housing when the contact module is fully loaded in the housing, the contact module including opposed sides and a module edge; and a retention latch member formed separate from, and held within, the contact module, the retention latch member extending beyond the module edge, the retention latch member engaging the latch element on the module support shroud to retain securely the contact module in the housing.

2. The electrical connector of claim 1, further comprising a carrier strip having the retention latch member and the contacts both jointly formed thereon, the retention latch member and contacts being removed from the carrier strip when assembled in the dielectric carrier.

3. The electrical connector of claim 1, wherein the retention latch member and contacts are formed of a common conductive material.

4. The electrical connector of claim 1, wherein the retention latch member includes a latch base that is joined at one end to a latch beam, the latch base being securely held within a chamber in the carrier, the latch beam extending out of the chamber beyond the module edge.

5. The electrical connector of claim 1, wherein the carrier includes a back shell and a cover that are joined to one another by posts that extend there between, the retention latch member having at least one hole therethrough that receives at least one of the posts to securely retain the retention latch member within the carrier.

6. The electrical connector of claim 1, wherein the retention latch member includes a protrusion on an outer end thereof and the latch element on the module support shroud constitutes a window aligned to receive the protrusion when the contact module is fully loaded in the housing.

7. The electrical connector of claim 1, wherein the retention latch member includes a guide rail along the module edge, the retention latch member being located at an intermediate gap in the guide rail and extending along the guide rail.

8. The electrical connector of claim 1, wherein the module support shroud includes a slot therein that receives the module edge of the contact module, the latch element being aligned with the slot.

9. The electrical connector of claim 1, further comprising a plurality of the contact modules that are narrow in thickness between the opposed sides relative to a height and length of each of the contact modules, the contact modules being held adjacent one another in the housing.

10. The electrical connector of claim 1, wherein the contact module represents one of a signal contact module and a power contact module.

11. An electrical contact module configured to be loaded into a connector housing having a front wall separating a mating end from a loading end and having a module support shroud extending from the front wall toward the loading end, wherein the module support shroud having a latch element provided thereon, the contact module comprising:

an array of contacts held in a dielectric carrier that has opposed sides with a height and a length, the sides being separated by a module thickness that is narrow relative to the height and length of the sides, the carrier including a mating end and module edge, the mating end being configured to be located proximate the front wall when the contact module is fully loaded in the housing, the module edge being positioned to slide along the module support shroud as the contact module is loaded; and a retention latch member formed separate from, and held within the carrier, the retention latch member extending beyond the module edge, the retention latch member being configured to engage the latch element on the module support shroud to retain securely the contact module in the housing.

12. The contact module of claim 11, further comprising a carrier strip having the retention latch member and the contacts both jointly formed thereon, the retention latch member and contacts being removed from the carrier strip when assembled in the dielectric carrier.

13. The contact module of claim 11, wherein the retention latch member and contacts are formed of a common conductive material.

14. The contact module of claim 11, wherein the retention latch member is formed of conductive material and the carrier is formed of an insulation material.

15. The contact module of claim 11, wherein the retention latch member includes a latch base that is joined at one end to a latch beam, the latch base being securely held within a chamber in the carrier, the latch beam extending out of the chamber beyond the module edge.

16. The contact module of claim 11, wherein the carrier includes a back shell and a cover that are joined to one another by posts that extend there between, the retention latch member having at least one hole therethrough that receives at least one of the posts to securely retain the retention latch member within the carrier.

17. The contact module of claim 11, wherein the retention latch member includes a protrusion on an outer end thereof and the latch element on the module support shroud constitutes a window aligned to receive the protrusion when the contact module is fully loaded in the housing.

18. The contact module of claim 11, wherein the retention latch member includes a guide rail along the module edge, the retention latch member being located at an intermediate gap in the guide rail and extending along the guide rail.

19. The contact module of claim 11, wherein the contact module includes a board mounting end that is aligned at a right angle to the mating end, the contacts having pins that extend from the mating and board mounting ends.

20. The contact module of claim 11, wherein the contact module represents one of a signal contact module and a power contact module.

* * * * *